US007985144B1

(12) United States Patent
Gonzales

(10) Patent No.: US 7,985,144 B1
(45) Date of Patent: Jul. 26, 2011

(54) GOLF SWING TRAINING GARMENT

(76) Inventor: Richard J. Gonzales, Stockton, CA (US)

( * ) Notice: Subject to any disclaimer, the term of this patent is extended or adjusted under 35 U.S.C. 154(b) by 0 days.

(21) Appl. No.: 12/898,433

(22) Filed: Oct. 5, 2010

(51) Int. Cl.
*A63B 69/36* (2006.01)
*A41D 1/02* (2006.01)

(52) U.S. Cl. ..... 473/212; 473/277; 2/93

(58) Field of Classification Search ..... 473/205, 473/206, 212, 215, 229, 266, 276, 277, 422; 2/2, 85, 93
See application file for complete search history.

(56) References Cited

U.S. PATENT DOCUMENTS

| | | | | |
|---|---|---|---|---|
| 2,808,267 | A | 10/1957 | Heaton | |
| 3,970,316 | A | 7/1976 | Westmoreland, Jr. | |
| 4,058,852 | A | 11/1977 | Aragona | |
| 4,890,841 | A | 1/1990 | Brooks | |
| 4,892,317 | A | 1/1990 | Corder, Jr. | |
| 4,940,237 | A * | 7/1990 | Mortensen | 473/212 |
| 5,295,690 | A | 3/1994 | Johnson | |
| 5,951,408 | A | 9/1999 | Inman | |
| 6,126,554 | A | 10/2000 | Poscente | |
| 6,767,290 | B1 | 7/2004 | Tan | |
| 7,117,538 | B2 | 10/2006 | Bosne | |
| 7,134,969 | B2 * | 11/2006 | Citron et al. | 473/277 |

* cited by examiner

*Primary Examiner* — Nini Legesse
(74) *Attorney, Agent, or Firm* — Neustel Law Offices

(57) ABSTRACT

A garment for retaining proper arm positioning throughout a complete golf swing while being substantially unnoticeable to nearby persons. The garment includes a shirt having a torso portion, a first and second sleeve extending from the torso portion, a pair of anchor members secured to the interior surface of the torso portion via a support strip, and a pair of retaining bands separately encircling the first and second sleeves along an interior surface and generally retained within a channel along the inside of the respective sleeve, the retaining bands being comprised of a stretchable material and each having a catch portion with adjustment slots. The retaining bands extend out of the respective sleeve through a sleeve slot and interior to the torso portion via a torso slot to be secured to the respective anchor member and thus separately restrict movement of the sleeves with respect to the torso portion.

20 Claims, 7 Drawing Sheets

GOLF SWING TRAINING GARMENT

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a training aid and more specifically it relates to a golf swing training garment for efficiently retaining proper arm positioning throughout a complete golf swing while being substantially unnoticeable to nearby persons.

2. Description of the Related Art

Any discussion of the related art throughout the specification should in no way be considered as an admission that such related art is widely known or forms part of common general knowledge in the field.

Golf swing training aids have been in use for years, as the golf swing is generally known as a difficult movement to master. Prior training aids have generally been unfavorable to golfers in that the training aids did not properly assist in developing muscle memory to achieve the proper golf swing, or were obtrusive in nature and thus not desirable to wear or use while practicing on a golf course. Because of the inherent problems with the related art, there is a need for a new and improved golf swing training garment for efficiently retaining proper arm positioning throughout a complete golf swing while being substantially unnoticeable to nearby persons.

BRIEF SUMMARY OF THE INVENTION

A system for efficiently retaining proper arm positioning throughout a complete golf swing while being substantially unnoticeable to nearby persons. The invention generally relates to a training aid which includes a shirt having a torso portion, a first and second sleeve extending from the torso portion, a pair of anchor members secured to the interior surface of the torso portion via a support strip, and a pair of retaining bands separately encircling the first and second sleeves along an interior surface and generally retained within a channel along the inside of the respective sleeve, the retaining bands being comprised of a stretchable material and each having a catch portion with adjustment slots. The retaining bands extend out of the respective sleeve through a sleeve slot and interior to the torso portion via a torso slot to be secured to the respective anchor member and thus separately restrict movement of the sleeves with respect to the torso portion.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
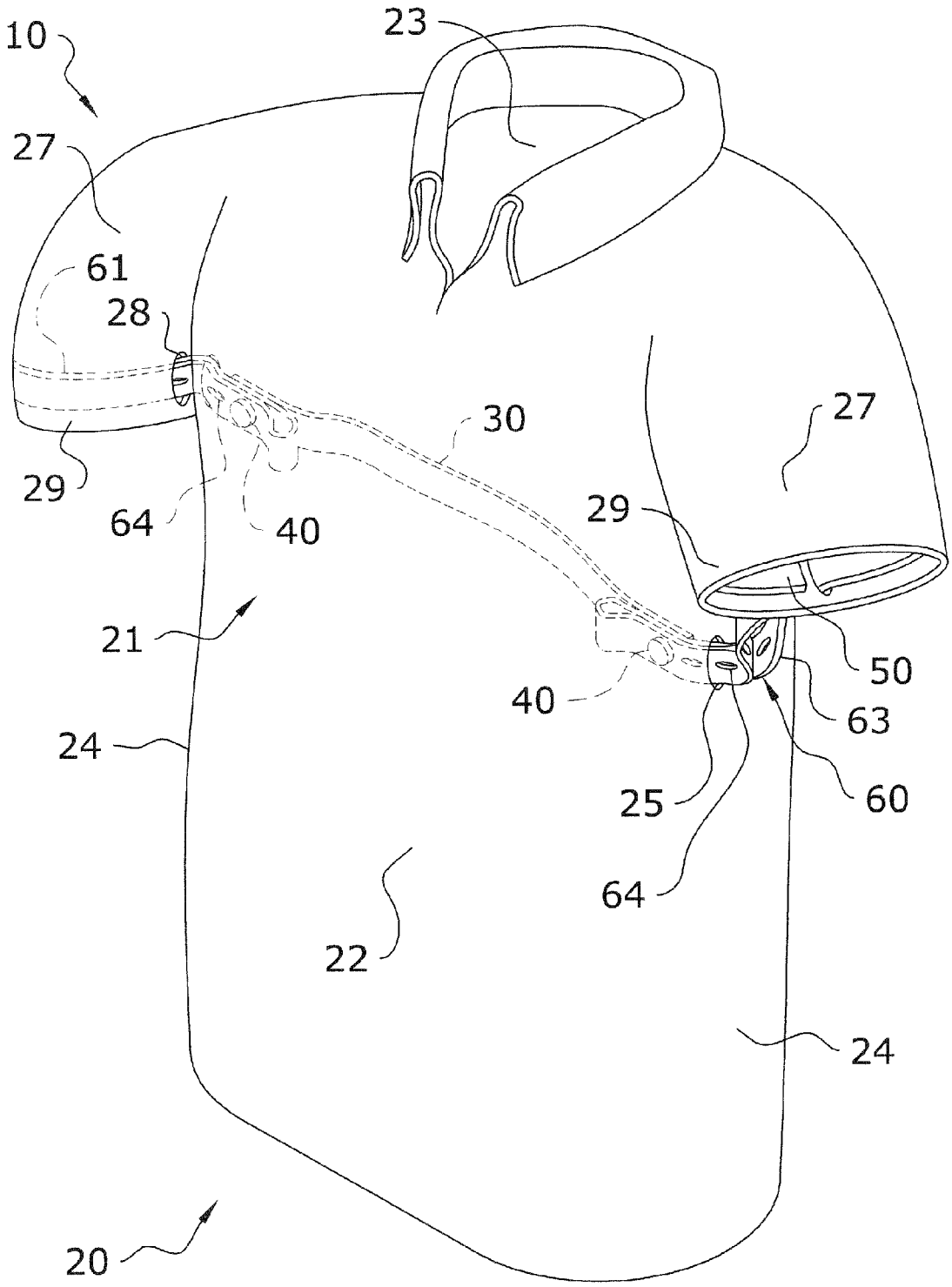
FIG. 1 is an upper perspective view of the present invention with the sleeve attached to the torso portion with respect to the retaining band.
Figure 2:
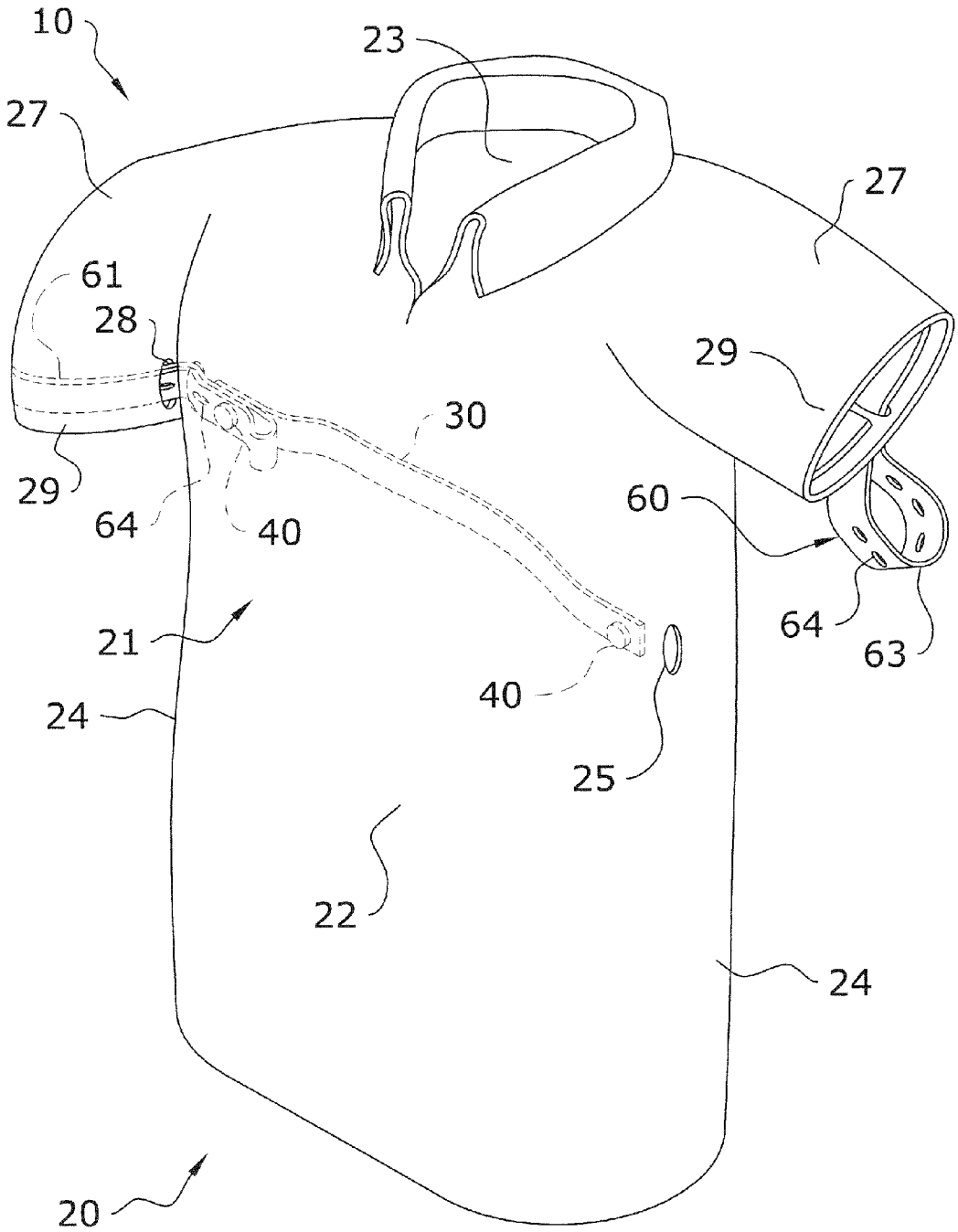
FIG. 2 is an upper perspective view of the present invention with the sleeve detached from the torso portion with respect to the retaining band.
Figure 3:
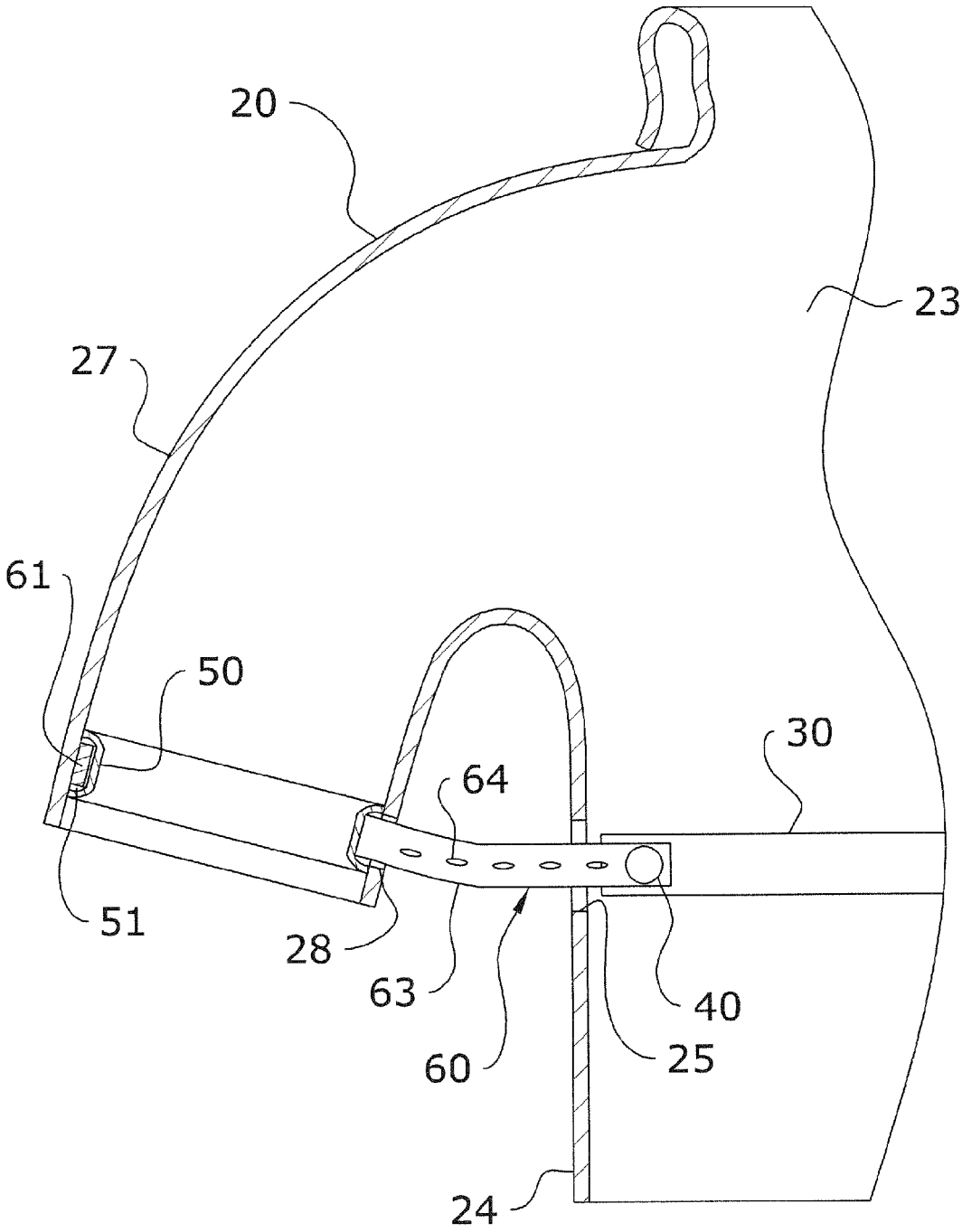
FIG. 3 is a front sectional view of the present invention showing the sleeve attached to the torso portion with respect to the retaining band, the retaining band attached via a first adjustment slot.
Figure 4:
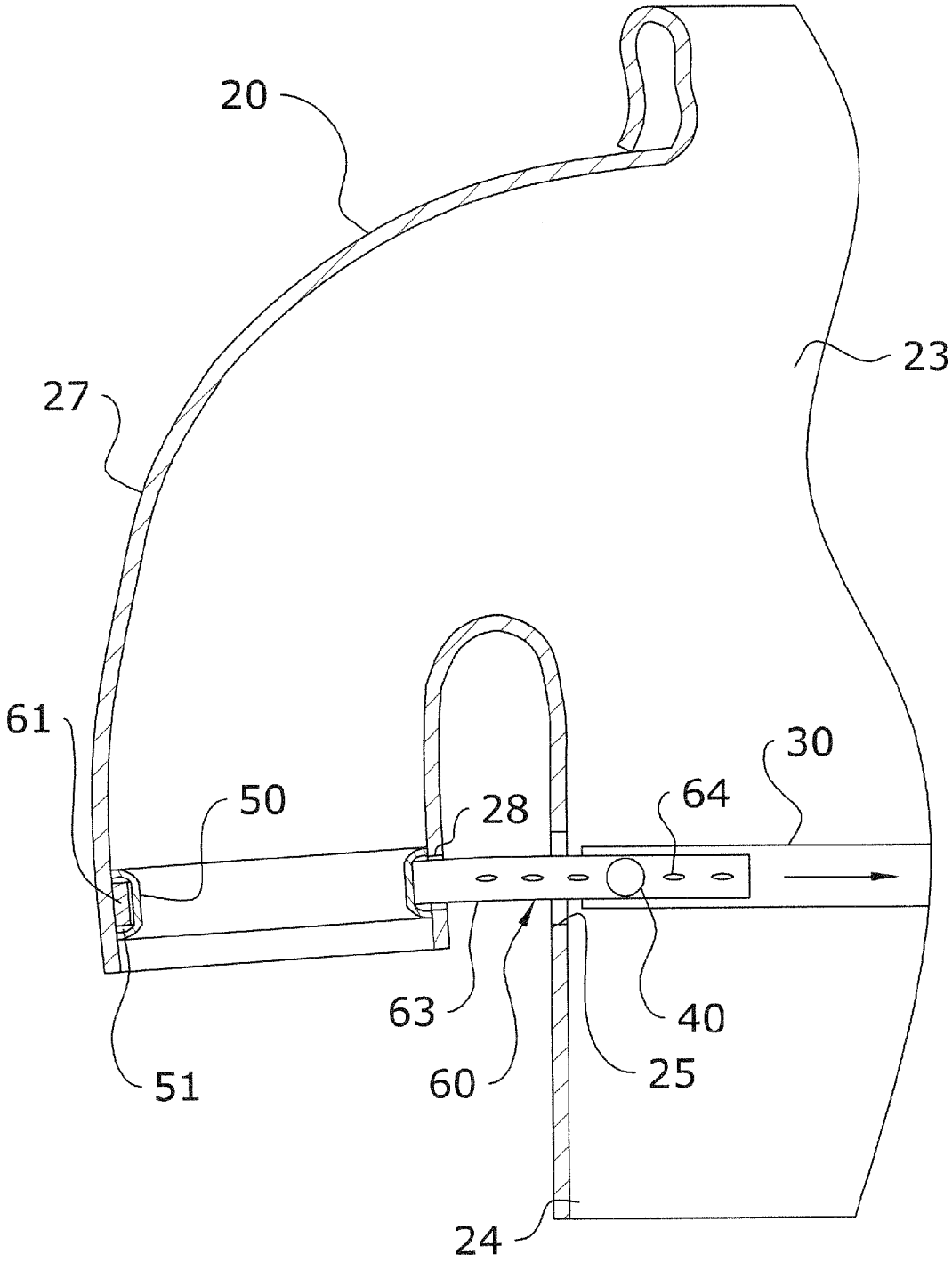
FIG. 4 is a front sectional view of the present invention showing the sleeve attached to the torso portion with respect to the retaining band, the retaining band attached via a second adjustment slot.

A. Overview.

Turning now descriptively to the drawings, in which similar reference characters denote similar elements throughout the several views, FIGS. 1 through 7 illustrate a golf swing training garment 10, which comprises a shirt 20 having a torso portion 21, a first and second sleeve 27 extending from the torso portion 21, a pair of anchor members 40 secured to the interior surface of the torso portion 21 via a support strip 30, and a pair of retaining bands 60 separately encircling the first and second sleeves 27 along an interior surface and generally retained within a channel 51 along the inside of the respective sleeve 27, the retaining bands 60 being comprised of a stretchable material and each having a catch portion 63 with adjustment slots 64. The retaining bands 60 extend out of the respective sleeve 27 through a sleeve slot 28 and interior to the torso portion 21 via a torso slot 25 to be secured to the respective anchor member 40 and thus separately restrict movement of the sleeves 27 with respect to the torso portion 21.

B. Shirt.

The shirt 20 has a torso portion 21 having a front 22 to cover the chest, abdomen and a back 23 to cover the person's back and having a neck opening, and sleeves 27 to cover the upper arms of the wearer, and generally resembles and mimics a conventional shirt. The shirt 20 generally is structured to resemble a golfing shirt, such as a collared shirt or non collared shirt, being short-sleeve or long-sleeve, short-sleeved being preferred. The shirt 20 may be comprised of various materials, such as breathable cotton, etc. It is appreciated that various other types of shirts may be appreciated and utilized with the present invention other than those types described.

The torso portion 21 also generally includes a slot 25 of a similar length as the width of the retaining band 60. The slot 25 is located along the side 24 of the torso portion 21 and generally just below the armpit to align with the upper arm of the wearer. The slot 25 is generally formed to be substantially unnoticeable to nearby persons. The sleeve 27 also generally includes a slot 28 on a part of the sleeve 27 facing the torso portion 21 and generally near the end of the sleeve 27 to align with the slot 25 of the torso portion 21, such as right above the cuff 29 of the sleeve 27. The slot 28 of the sleeve 27 is similar in construction and size as the slot 25 of the torso portion 21 and is also generally substantially concealed to nearby persons.

It is appreciated that the right and left sides of the shirt 20 are generally identical for separately retaining or limiting a movement of each of the sleeves 27 of the shirt 20 and thus each of the arms of the wearer with respect to the torso portion 21. Each of the sleeves 27 may be separately adjustable in a degree of movement for accommodating different swing types, right or left-handed golfers, etc.

C. Support Strip (Torso Located).

The torso located support strip 30 is affixed, via generally being sewn or through adhesive, to the inside surface of the torso portion 21. The support strip 30 is generally elongated in structure and is used to reinforce the anchor members 40. The support strip 30 is generally comprised of a facing tape material; however other materials may be appreciated. The support strip 30 preferably extends from a right to a left side of the torso portion 21 and is generally along the inside surface of the back 23 of the torso portion 21 and is generally substantially unnoticeable from an exterior of the shirt 20.

D. Anchor Member.

The anchor member 40 is secured to the end of the support strip 30 and generally a pair of anchor members 40 are used, one being on each end of the support strip 30 for the respective sleeve 27. The anchor member 40 may be secured to the support strip 30 in various manners, such as being sewn thereon. The anchor member 40 is attached to the support strip 30 to be located within the interior of the shirt 20 to be hidden from view and thus unnoticeable from an exterior side of the shirt 20. The anchor member 40 is generally comprised of button structure; however other structures may be appreciated.

E. Support Strip (Sleeve Located).

The sleeve located support strip 50 is located adjacent the cuff 29 of the sleeve 27 and generally encircles the inside of the sleeve 27 while being attached along an interior surface of the sleeve 27 to be substantially unnoticeable and concealed from an exterior side of the shirt 20. The support strip 50 may be comprised of various materials, such as facing tape, and thus adhesively adhered to the inside surface of the sleeve 27. Other manners to attach the support strip 50 may be utilized, such as sewing the support strip 50 to the sleeve 27.

Figure 5:
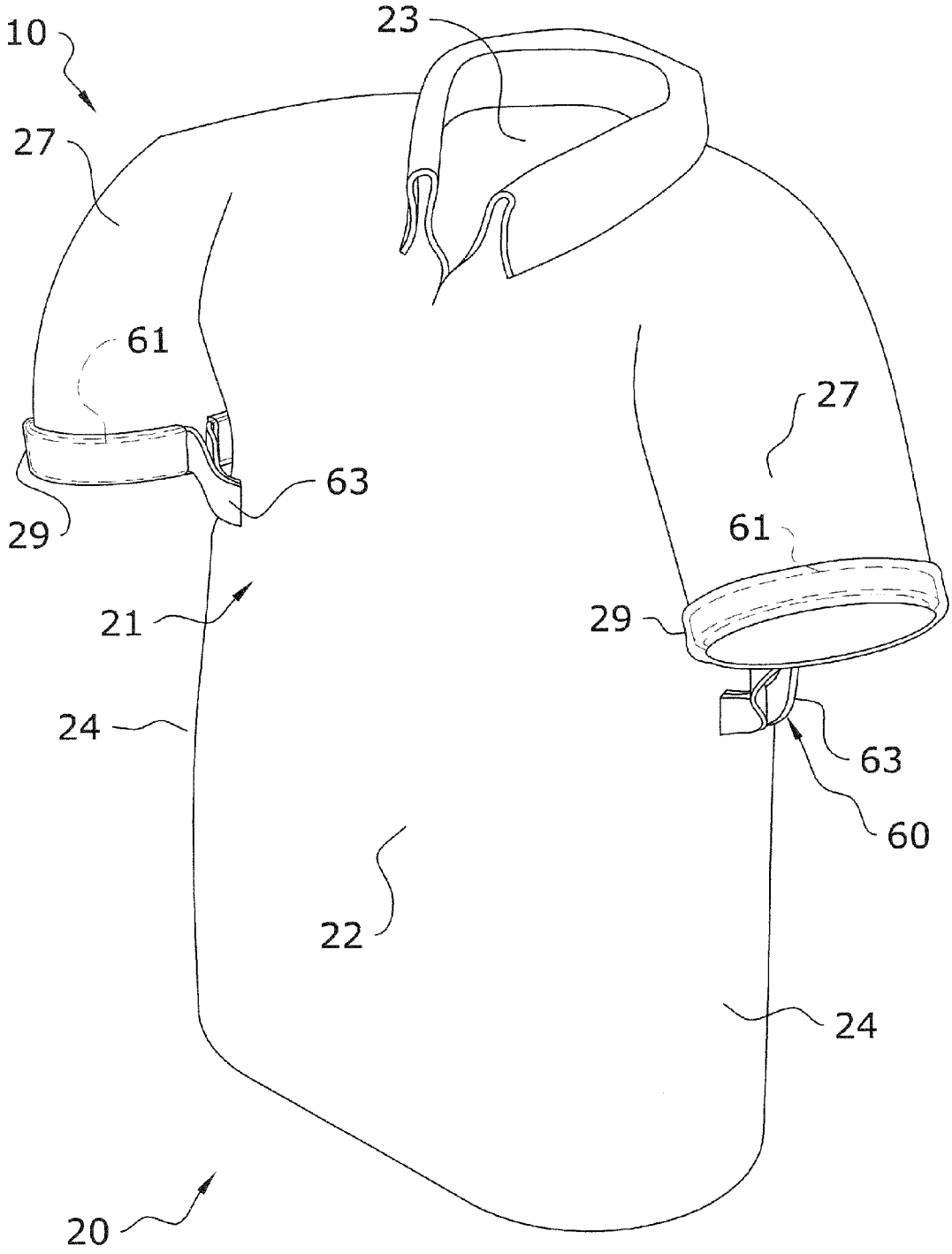
FIG. 5 is an upper perspective view of an alternate embodiment of the present invention.
Figure 6:
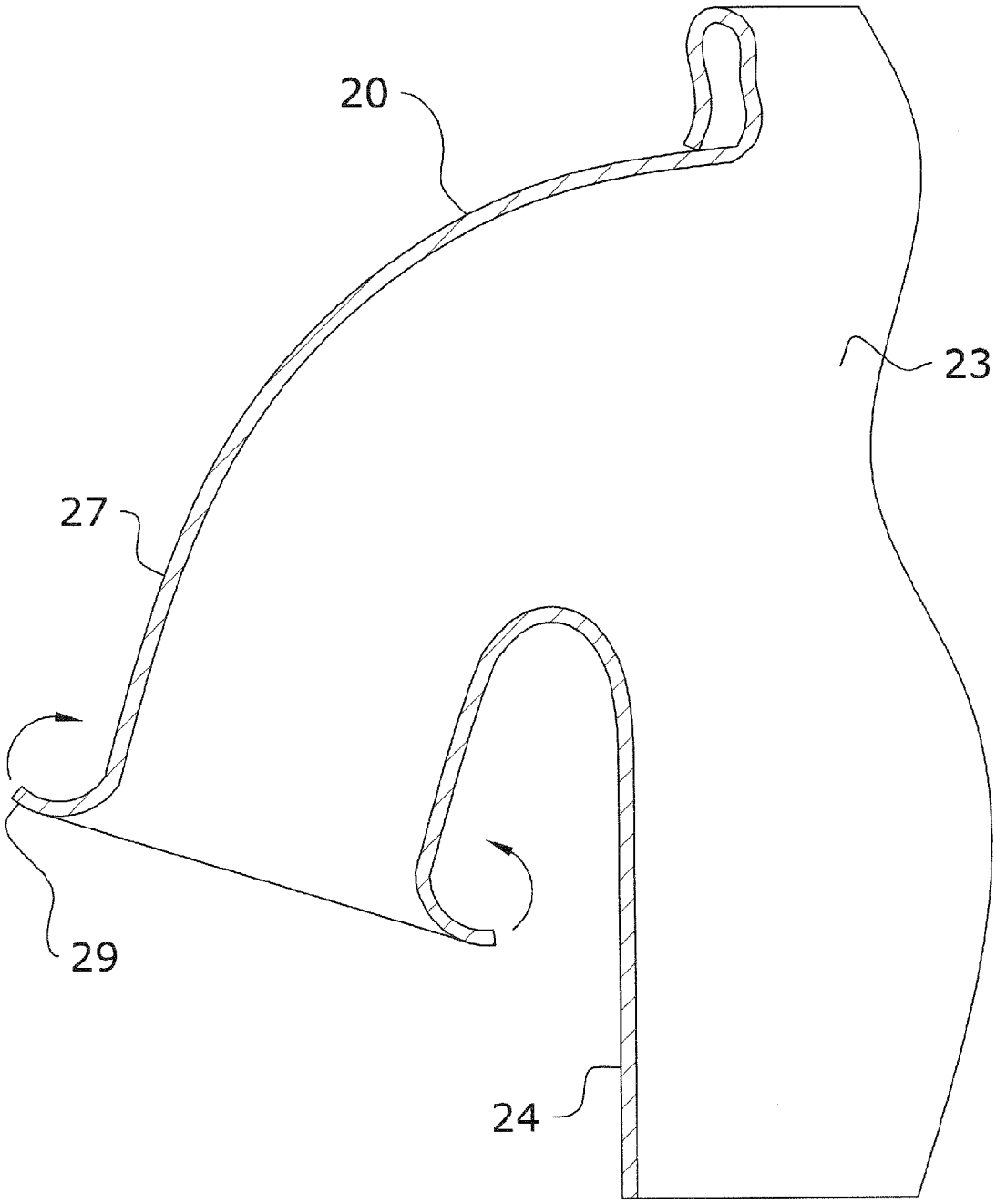
FIG. 6 is a front sectional view of the alternate embodiment showing the cuff of the sleeve being formed from the longer sleeve.
Figure 7:
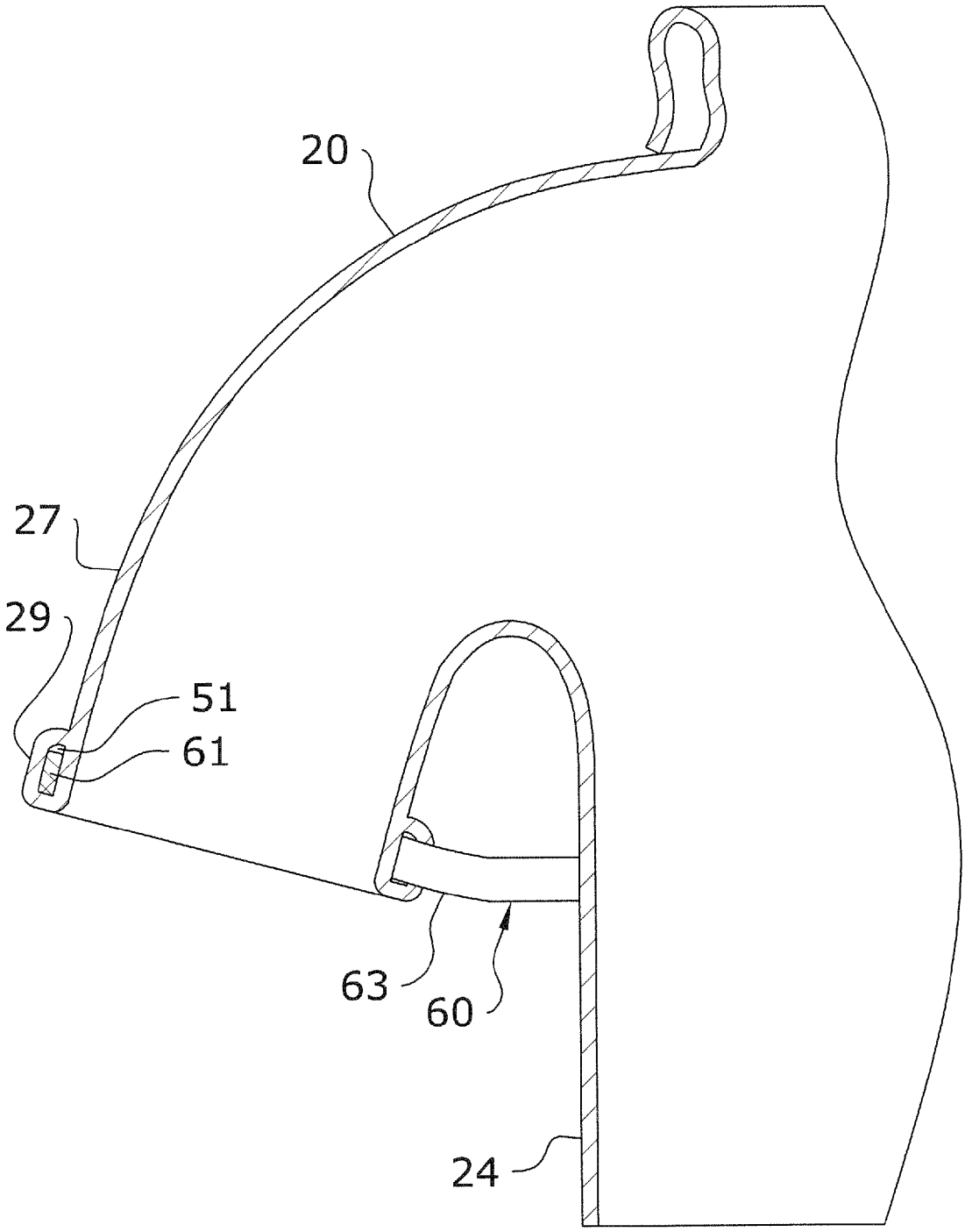
FIG. 7 is a front sectional view of the alternate embodiment showing the sleeve attached to the torso portion with respect to the retaining band.

The support strip 50 forms a channel 51 between the support strip 50 and the sleeve 27 for receiving the retaining band 60. The channel 51 connects with the slot 28 of the sleeve 27 for exiting of a portion of the retaining band 60 from the channel 51 to connect to the anchor member 40 on the interior side of the torso portion 21. The channel 51 may also be formed via a long-sleeved shirt having the sleeves 27 cut and rolled approximately one inch above the elbow to form a channeled-cuff 29 to receive the retaining band 60 as illustrated in FIGS. 5 through 7.

F. Retaining Band.

The retaining band 60 is comprised of an elastic or other stretchable material and is used to connect the end of the sleeve 27 (near the cuff 29) to the torso portion 21 of the shirt 20 to restrict movement of the sleeve 27 and thus upper arm contained by the sleeve 27 to improve muscle memory of the wearer to execute a proper golf swing. The retaining band 60 is generally formed in a loop shape to encircle the arm through the channel 51.

It is appreciated that in alternate embodiments, hook and loop fasteners, magnets, snaps, rubber bands, or various other fasteners may be used in place of the retaining bands 60. In another alternate embodiment, the distal end of the loop-shaped retaining band 60 may be attached directly to the torso portion 21 along the respective side 24, rather than extending within the slot 25 to the anchor member 40.

The retaining band 60 includes a first portion 61 and a second portion 63, the second portion 63 being integral with the first portion 61 and defined by the location of the first portion 61 and the second portion 63 with respect to the sleeve 27. The first portion 61 extends through the channel 51 to encircle the arm and follow the circular shape of the sleeve 27, thus the first portion 61 may stretch to accommodate different arm diameters.

The second portion 63 of the retaining band 60 extends through the slot 28 of the sleeve 27 and is for extending within the slot 25 of the torso portion 21 and being connected to the anchor member 40. The retaining band 60 is connected to the sleeve 27 between the first portion 61 and the second portion 63 to prevent the second portion 63 from being pulled through the slot 28 and within the channel 51 unintentionally, such as when not connected to the anchor member 40. The retaining band 60 may be connected to the sleeve 27 in various manners, such as being sewn to the sleeve 27.

The second portion 63 includes a plurality of adjustment slots 64 spaced along the length of the second portion 63. The adjustment slots 64 allow for tightening or loosening slack of the retaining band 60 and thus restricting or allowing an amount of movement of the sleeve 27 with respect to the torso portion 21. Generally, the retaining band 60 being comprised of a loop structure, the second portion 63 has slots 64 aligning on each front and back loop portions to each be collectively received by the anchor member 40. It is appreciated that the wearer may attach the retaining bands 60 of the right and left arms at different respective slots 64 if one sleeve 27 is desired to be more or less restricted in movement than the other.

G. Operation of Preferred Embodiment.

In use, the shirt 20 is worn and the second portion 63 having the adjustment slots 64 is extended through the slot 25 of the torso portion 21 and connected to the anchor member 40. The sleeve(s) 27 is now restricted in movement to ensure that the golfer retains a proper positioning of the arm in relation to the torso when swinging a golf club. The elastic retaining bands 60 allow for a degree of flexibility when swinging the golf club so as not to be uncomfortable and also returns to an initial position after the swing for repeated movement. The restricting elements and support elements of the garment 10 are also substantially concealed by being attached to the inside surface of the shirt 20, thus allowing the wearer to wear the garment 10 comfortably while upon a driving range or a regular golf course.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A golf swing training garment, comprising:

a shirt having a torso portion, a first sleeve extending from said torso portion, and a second sleeve extending from said torso portion;

wherein said torso portion has a torso slot on a side of said torso portion, said torso slot being adjacent an upper arm of a wearer;

wherein said first sleeve has a sleeve slot, said sleeve slot being adjacent said torso portion and said torso slot;

an anchor member secured to said torso portion, said anchor member being located along an interior surface of said torso portion adjacent said torso slot; and a retaining band encircling said first sleeve along an interior surface of said first sleeve, said retaining band being comprised of a stretchable material and said retaining band having a catch portion along a distal end;

wherein said retaining band extends through said sleeve slot and within said torso slot, said catch portion being secured to said anchor member to restrict movement of said first sleeve with respect to said torso portion.

2. The golf swing training garment of claim 1, wherein said shirt is comprised of a collared shirt.

3. The golf swing training garment of claim 1, including a support member secured to said interior surface of said torso portion.

4. The golf swing training garment of claim 3, wherein said support member is secured to said interior surface along a back side of said torso portion.

5. The golf swing training garment of claim 3, wherein said anchor member is secured to said support member.

6. The golf swing training garment of claim 1, wherein said retaining band is affixed to said first sleeve adjacent said sleeve slot to restrict said distal end from passing completely through said sleeve slot.

7. The golf swing training garment of claim 1, wherein said catch portion is comprised of a plurality of spaced-apart adjustment slots to be individually secured to said anchor member.

8. The golf swing training garment of claim 7, wherein said anchor member is comprised of a button.

9. The golf swing training garment of claim 1, wherein said first sleeve has a support member secured to said interior surface of said first sleeve, said support member forms a channel between said support member and said interior surface of said first sleeve, said retaining band positioned within said channel.

10. A golf swing training garment, comprising:

a shirt having a torso portion, a first sleeve extending from said torso portion, and a second sleeve extending from said torso portion;

wherein said torso portion has a first torso slot on a first side of said torso portion, said first torso slot being adjacent a first upper arm of a wearer;

wherein said torso portion has a second torso slot on a second side of said torso portion, said second torso slot being adjacent a second upper arm of a wearer;

wherein said first sleeve has a first sleeve slot, said first sleeve slot being adjacent said torso portion and said first torso slot;

wherein said second sleeve has a second sleeve slot, said second sleeve slot being adjacent said torso portion and said second torso slot;

a first anchor member secured to said torso portion, said first anchor member being located along an interior surface of said torso portion adjacent said first torso slot;

a second anchor member secured to said torso portion, said second anchor member being located along an interior surface of said torso portion adjacent said second torso slot;

a first retaining band encircling said first sleeve along an interior surface of said first sleeve, said first retaining band being comprised of a stretchable material and said first retaining band having a first catch portion along a distal end;

wherein said first retaining band extends through said first sleeve slot and within said first torso slot, said first catch portion being secured to said first anchor member to restrict movement of said first sleeve with respect to said torso portion; and a second retaining band encircling said second sleeve along an interior surface of said second sleeve, said second retaining band being comprised of a stretchable material and said second retaining band having a second catch portion along a distal end;

wherein said second retaining band extends through said second sleeve slot and within said second torso slot, said second catch portion being secured to said second anchor member to restrict movement of said second sleeve with respect to said torso portion.

11. The golf swing training garment of claim 10, wherein said shirt is comprised of a collared shirt.

12. The golf swing training garment of claim 10, including a support member secured to said interior surface of said torso portion.

13. The golf swing training garment of claim 12, wherein said support member extends laterally across said torso portion.

14. The golf swing training garment of claim 13, wherein said support member is secured to said interior surface along a back side of said torso portion.

15. The golf swing training garment of claim 13, wherein said first anchor member is secured to a first end of said support member and wherein said second anchor member is secured to a second end of said support member.

16. The golf swing training garment of claim 10, wherein said first retaining band is affixed to said first sleeve adjacent said first sleeve slot to restrict said distal end of said first retaining band from passing completely through said first sleeve slot and wherein said second retaining band is affixed to said second sleeve adjacent said second sleeve slot to restrict said distal end of said second retaining band from passing completely through said second sleeve slot.

17. The golf swing training garment of claim 10, wherein said first catch portion is comprised of a plurality of spaced-apart first adjustment slots to be individually secured to said first anchor member and wherein said second catch portion is comprised of a plurality of spaced-apart second adjustment slots to be individually secured to said second anchor member.

18. The golf swing training garment of claim 17, wherein said first anchor member is comprised of a button and wherein said second anchor member is comprised of a button.

19. The golf swing training garment of claim 10, wherein said first sleeve has a first support member secured to said interior surface of said first sleeve, said first support member forms a first channel between said first support member and said interior surface of said first sleeve, said first retaining band positioned within said first channel and wherein said second sleeve has a second support member secured to said interior surface of said second sleeve, said second support member forms a second channel between said second support member and said interior surface of said second sleeve, said second retaining band positioned within said second channel.

20. A golf swing training garment, comprising:

a shirt having a torso portion, a first sleeve extending from said torso portion, and a second sleeve extending from said torso portion;

wherein said torso portion has at least one torso slot on a side of said torso portion, said torso slot being adjacent an upper arm of a wearer;

wherein said first sleeve has at least one sleeve slot, said sleeve slot being adjacent said torso portion and said torso slot;

a first support strip secured to an interior surface of said torso portion;

at least one anchor member sewn to said first support strip, said anchor member being adjacent said torso slot;

wherein said anchor member is comprised of a button;

at least one second support strip secured to an interior surface of said first sleeve, said second support strip being adjacent a cuff of said first sleeve and said second support strip forms a channel between said second support strip and said interior surface of said first sleeve; and at least one retaining band encircling said first sleeve along an interior surface of said first sleeve, said retaining band having a first portion positioned within said channel and having a second portion extending from said first sleeve through said sleeve slot;

wherein said second portion includes a plurality of spaced-apart adjustment slots;

wherein said retaining band is comprised of a stretchable material;

wherein said retaining band is sewn to said first sleeve between said first portion and said second portion to restrict said second portion from entering said channel;

wherein said second portion of said retaining band extends through said torso slot, one of said adjustment slots of said second portion being secured to said anchor member to restrict movement of said first sleeve with respect to said torso portion.

* * * * *